United States Patent [19]

Sinden

[11] Patent Number: 4,501,309

[45] Date of Patent: Feb. 26, 1985

[54] PORTABLE WOOD SPLITTER

[76] Inventor: Leon Sinden, 412 Sperry, Bakersfield, Calif. 93307

[21] Appl. No.: 521,523

[22] Filed: Aug. 8, 1983

[51] Int. Cl.[3] ..... B27L 7/00

[52] U.S. Cl. ..... 144/193 A; 144/366

[58] Field of Search ..... 144/193 R, 193 A, 193 K, 144/366

[56] References Cited

U.S. PATENT DOCUMENTS

| | | | |
|---|---|---|---|
| 4,019,549 | 4/1977 | Williams | 144/193 A |
| 4,380,258 | 4/1983 | Hanser | 144/193 A |

*Primary Examiner*—W. D. Bray

*Attorney, Agent, or Firm*—Harvey B. Jacobson

[57] ABSTRACT

A pair of upstanding vertically elongated components are provided and each component includes upper and lower ends. The upper ends of the components are pivotally connected for relative swinging movement of the lower ends thereof toward and away from each other. The lower end of one of the components includes abutment surfaces facing toward the lower end of the other component and the lower end of the other component includes a wedge facing toward the abutment surfaces. An extendable hydraulic motor is operatively connected between the components for forcibly angularly displacing the components relative to each other to swing the lower ends thereof toward each other. The wedge-equipped component includes lower end foot structure for stationary support from a horizontal support surface and the abutment surface-equipped component includes lower end opposite side ground-engaging support wheels. Further, opposite side portions of the upper end of a first of said components includes horizontally outwardly projecting handgrip structure and the handgrip structure may be used to move the components about upon a horizontal support surface with which the support wheels are engaged in the same manner in which a hand truck may be wheeled and maneuvered over a horizontal support surface.

10 Claims, 6 Drawing Figures

PORTABLE WOOD SPLITTER

BACKGROUND OF THE INVENTION

Various forms of wood splitting devices heretofore have been provided. One of the primary types of wood splitting devices includes spaced apart abutment and wedge blade structures movable toward and away from each other for splitting a length of wood disposed therebetween. Some abutment and wedge blade structure equipped wood splitters include motor powered hydraulic circuitry and double-acting hydraulic cylinders for moving the abutment and wedge blade structures toward and away from each other. While these forms of wood splitters are considered desirable, the cost thereof is sometimes prohibitively high inasmuch as they not only require a double-acting hydraulic cylinder but also a hydraulic pump, a hydraulic reservoir and a motor for driving the hydraulic pump. In addition, some abutment and wedge blade structure equipped wood splitters utilize an electric motor driven screw jack for forcibly shifting the abutment and wedge blade structures toward and away from each other, but these electrically powered wood splitters require a source of electrical potential and also incorporate structure including the electric motor and the screw jack structure which are subject to maintenance problems.

Accordingly, a need exists for an improved form of wood splitter incorporating a conventional hydraulic bottle jack as the force developing structure by which the relatively movable abutment and wedge blade structures may be moved toward each other for the purpose of splitting a log section therebetween.

Examples of various different forms of wood splitting devices including some of the general structural and operational features of the instant invention are disclosed in U.S. Pat. Nos. 2,966,180, 3,779,295, 4,112,985 and 4,258,765.

BRIEF DESCRIPTION OF THE INVENTION

The wood splitter of the instant invention includes a pair of upstanding vertically elongated components having upper and lower ends. The upper ends of the components are pivotally connected together for relative swinging movement of the lower ends thereof toward and away from each other. The lower end of one of the components includes abutment surface structure facing toward the lower end of the other component as well as ground-engaging support wheels. The lower end of the other component includes wedge structure facing toward the abutment surface structure and also is equipped with depending support foot portions. A hydraulic bottle jack is operatively connected between the upstanding components for forcibly swinging the lower ends of the components toward each other and as the lower ends of the components swing toward each other the foot portion equipped component is maintained stationary while the ground-engaging support wheel equipped component moves over the associated support surface toward the lower end of the foot portion equipped component.

The main object of this invention is to provide a wood splitter which may incorporate a relatively inexpensive hydraulic bottle jack as the motive force for developing sufficient thrust forces between an abutment and a wedge edge to split a length of wood disposed between the abutment and wedge edge.

Another object of this invention is to provide a wood splitting apparatus of the manually operable type and which may be readily manually transported from one location to another in a manner similar to the manner in which a wheeled hand truck may be wheeled from one location to another.

Yet another important object of this invention is to provide a wood splitting apparatus including component parts thereof which may be readily disassembled for storage and/or shipment in a compact state.

Another very important object of this invention is to provide a wood splitter that may be economically mass produced.

Another object of this invention is to provide a wood splitter which may be readily manufactured in different sizes and ratings of wood splitting force.

A final object of this invention to be specifically enumerated herein is to provide a wood splitter in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
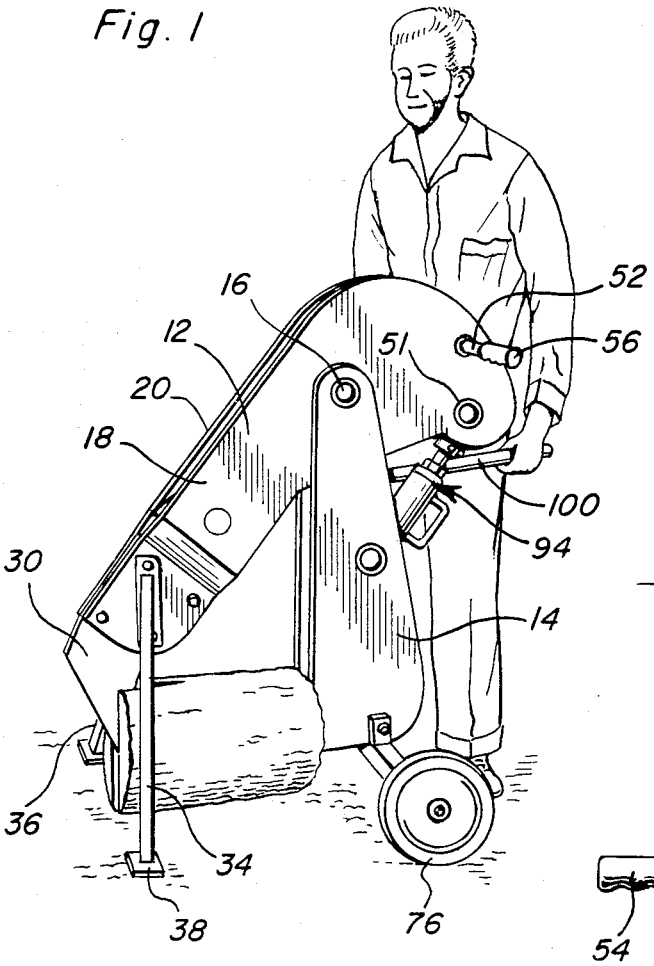
FIG. 1 is a perspective view of the log splitter of the instant invention in operative association with a log being split.
Figure 2:
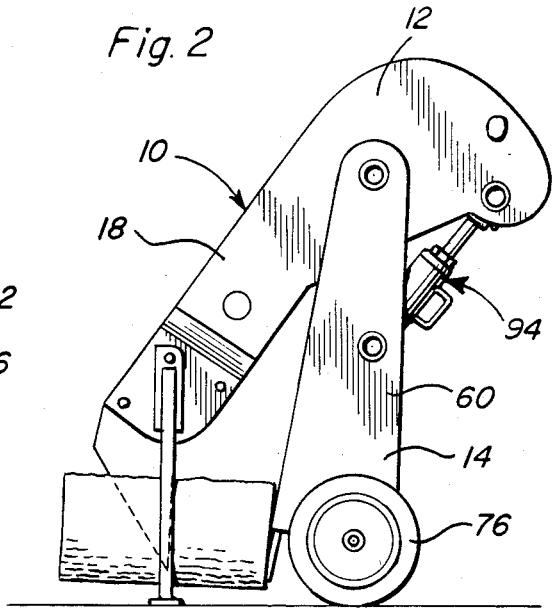
FIG. 2 is a side elevational view of the assemblage illustrated in FIG. 1 and with the wedge blade structure forced further through the associated log section.
Figure 3:
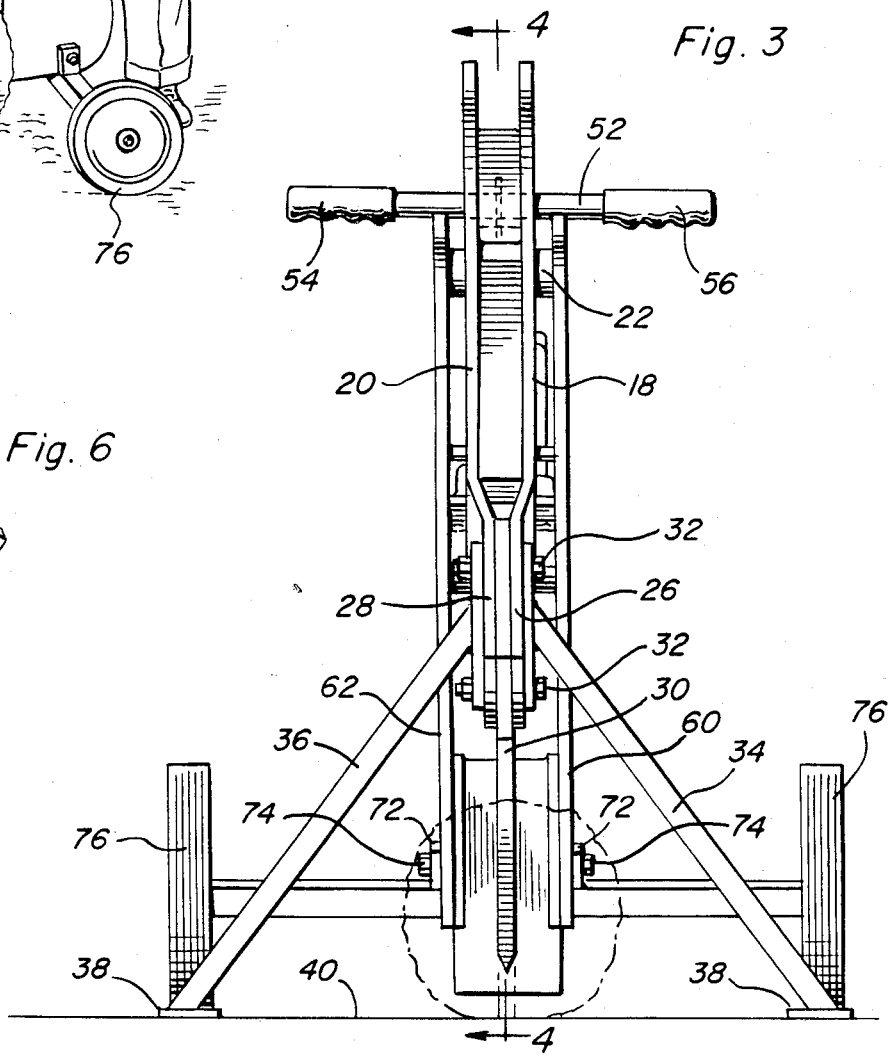
FIG. 3 is an enlarged elevational view of the wood splitter as seen from the left side of FIG. 1.
Figure 6:
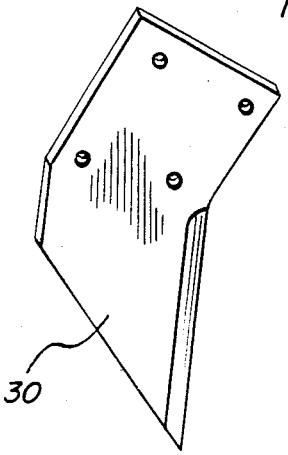
FIG. 6 is a perspective view of the combined wedge and cutting blade of the wood splitter.

Referring now more specifically to the drawings the numeral 10 generally designates the wood splitter of the instant invention. The wood splitter 10 includes first and second upstanding components 12 and 14 pivotally interconnected at their upper end portions by a pivot fastener 16. Accordingly, the lower ends of the components 12 and 14 are swingable toward and away from each other.

The first component 12 includes a pair of laterally spaced side plates 18 and 20 and a journal sleeve 22 extends and is secured therebetween with opposite ends of the sleeve 22 anchored within transverse bores 24 formed in the side plates 18 and 20. The lower extremities 26 and 28 of the plates 18 and 20 are laterally offset toward each other and clampingly engage the upper end of a depending combined wedge and blade structure 30. Suitable fasteners 32 are secured through the lower extremities 26 and 28 as well as the upper end of the blade structure 30 and two of the fasteners 32 are also utilized to mount a pair of downwardly divergent opposite side legs 34 and 36 from the extensions 26 and 28, the lower ends of the legs 34 including horizontal foot portions 38 for engaging an upwardly facing support surface 40.

The side plates 18 and 20 are also interconnected by a reinforcing tube 42 extending and secured therebetween as well as a bracing sleeve 44 extending and secured between the upper rear portions of the side plates 18 and 20. Further, the journal sleeve is braced by divergent reinforcing plates 46 and 48 secured to and extending outwardly from peripherally spaced portions of the sleeve 22 and extending longitudinally of the first component 12. The plates 46 and 48 are secured along the inner surfaces of the plates 18 and 20 by welding and the opposite ends of a small diameter tube 50 are secured in and open through openings 51 provided therefor in the side plates 18 and 20. A solid transverse handle shaft 52 is provided and includes a first handgrip 54 on one end and a second handgrip 56 on the other end. At least one of the handgrips 54 and 56 is removable and the handle shaft 52 may be telescoped into the small diameter tube 50 from one end thereof until the shaft 52 is substantially centered relative to the tube 50, after which a cotter pin 58 may be passed through suitable registered bores formed in the central portion of the small diameter tube 50 and the center portion of the handle shaft 52. In this manner, the handle shaft 52 is removable but is readily securable in adjusted position relative to the small diameter tube 50.

The second component 14 includes a pair of opposite side plates 60 and 62 interconnected at their upper ends by a tubular shaft portion 64 extending and secured therebetween. The shaft portion 64 is rotatably received in the journal sleeve 22 and a mounting sleeve 66 is also secured between the side plates 60 and 62 centrally intermediate the upper and lower ends thereof for a purpose to be hereinafter more fully set forth. The lower ends of the plates 60 and 62 have a transverse heavy gauge abutment plate 68 secured therebetween and a transverse axle assembly referred to in general by the reference numeral 70 has its mid-portion mounted from the outer sides of the lower portions of the plates 60 and 62 by mounting flange portions 72 secured to the outer sides of the plates 60 and 62 by fasteners 74. The opposite ends of the axle assembly 70 rotatably journal opposite side ground-engaging support wheels 76 therefrom rollingly engaged with the surface 40.

A pair of anchor pins 80 and 82 are secured between the plates 18 and 20 and the plates 60 and 62, respectively, and the opposite ends of a high tension expansion spring 84 are engaged with the anchor pins 80 and 82 and the spring 84 thus serves to yieldingly bias the components 12 and 14 to relatively angulated positions thereof with the abutment plate 68 spaced from the blade structure 30.

The bracing sleeve 44 rotatably receives a mount sleeve 88 thereon which supports a downwardly opening cup 90 and the downwardly opening cup 90 snugly seatingly receives the upper head end 92 of the extendable piston portion of a bottle jack referred to in general by the reference numeral 94 and removably supportingly engaged from a mounting plate 96 mounted on the sleeve 66 for angular displacement relative thereto. The cup 90 includes a setscrew 98 for releasably locking the head 92 within the cup 90 and the bottle jack 94 includes the conventional removable oscillatable handle 100 whereby the piston portion of the bottle jack 94 may be extended.

Figure 4:
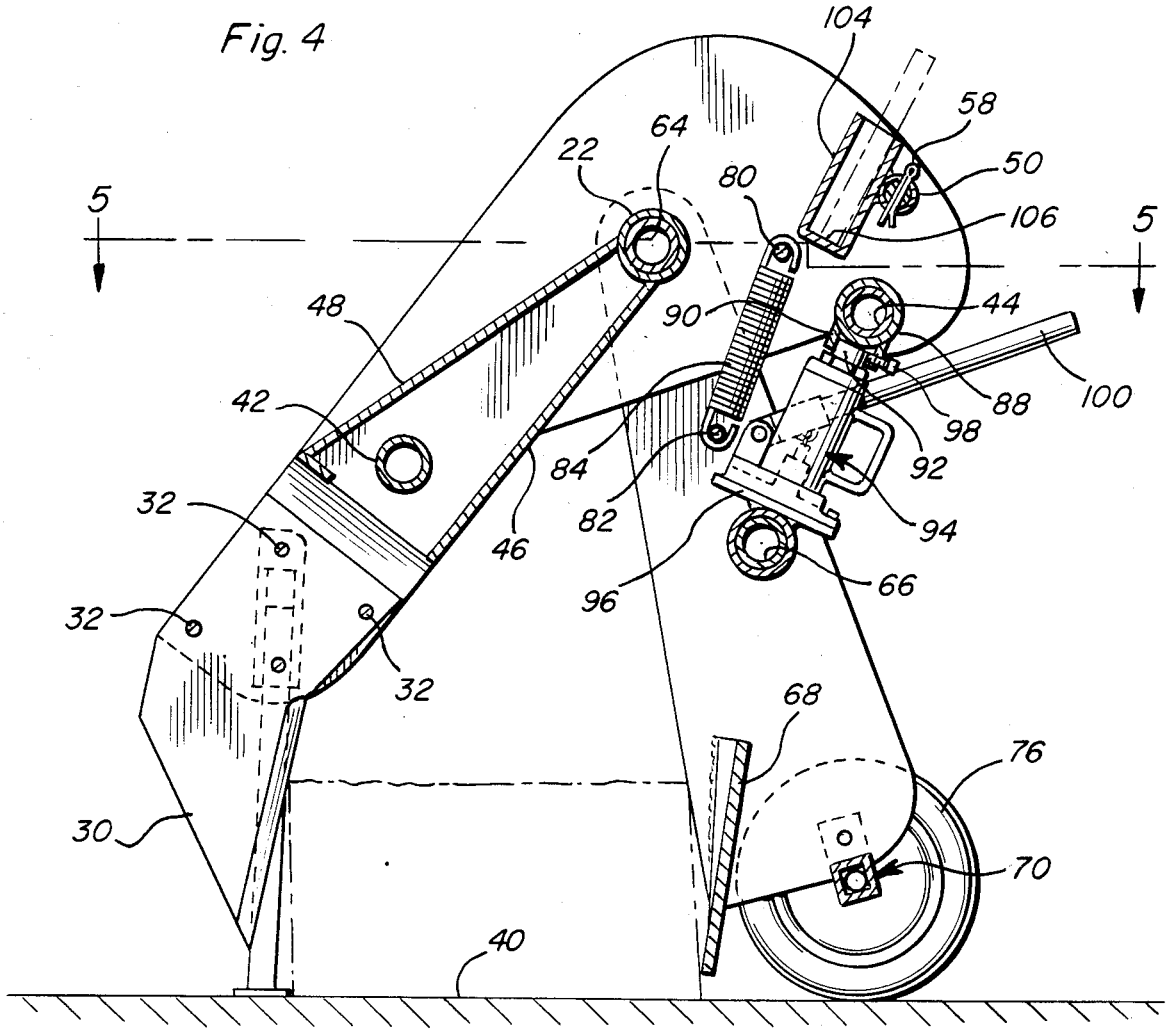
FIG. 4 is a vertical sectional view taken substantially upon the plane indicated by the section line 4—4 of FIG. 3.
Figure 5:
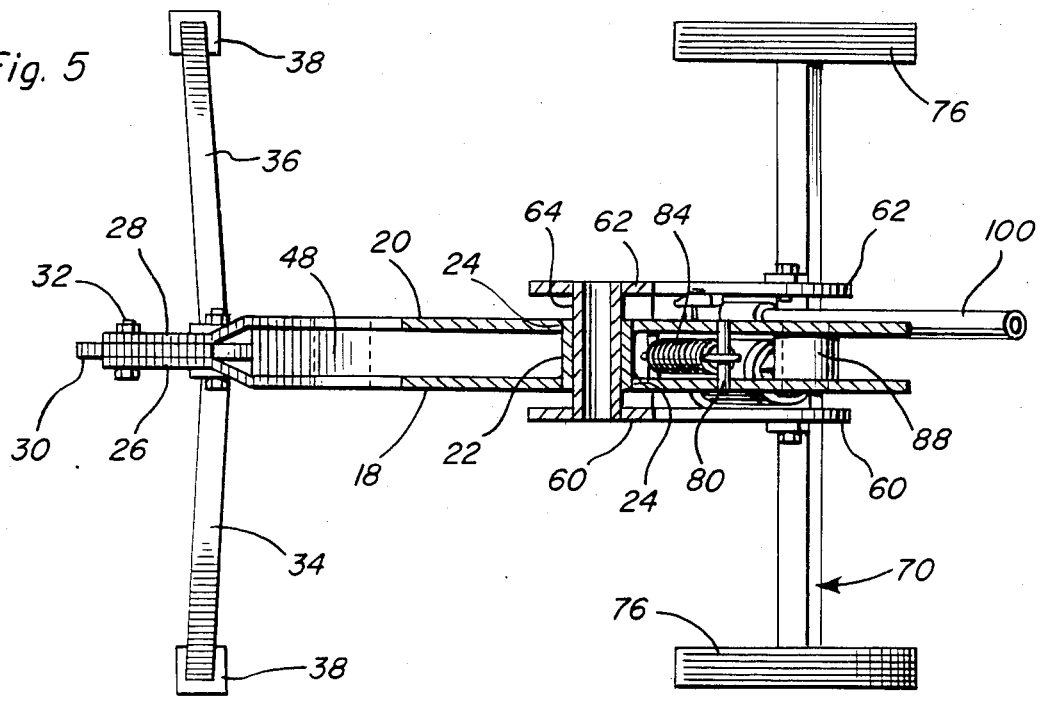
FIG. 5 is a horizontal sectional view taken substantially upon the plane indicated by the section line 5—5 of FIG. 4.

As may be best seen from FIG. 4 of the drawings a handle receiving sleeve 104 is also connected between the upper ends of the side plates 18 and 20. The sleeve 104 has opposite side portions thereof secured by welding to the inner side surfaces of the plates 18 and 20 and the lower end of the sleeve 104 is closed by a bottom wall 106. The handle 100 as well as other tools may be stored within the sleeve 104.

In operation, the relief valve (not shown) on the bottle jack 94 is opened and the spring 84 acts to swing the lower ends of the first and second components 12 and 14 away from each other as well as to retract the extendable piston of the bottle jack 94. Thereafter, a log to be split may be positioned on the surface 40 between the abutment plate 68 and the blade structure 30 and the relief valve of the bottle jack 94 may be closed. Thereafter, the handle 100 may be oscillated in order to cause the bottle jack 94 to extend the piston shaft thereof whereupon the lower ends of the components 12 and 14 will be swung toward each other in order to split the log. Utilization of a 20 ton jack results in approximately 10 tons of force being appliable to the blade structure 30 for advancing the latter through the log to be split.

As the included angle between the components 12 and 14 is reduced, the wheels 76 roll toward the legs 34 and 36 and the feet 38. In addition, when the bottle jack 94 is subsequently retracted under the biasing action of the expansion spring 94, the lower end of the component 14 moves away from the legs 34 and 36 and the feet 38.

The handgrips 54 and 56 enable the wood splitter 10 to be wheeled from one location to another in substantially the same manner in which a wheel-equipped hand truck may be maneuvered from one location to another.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A wood splitter including a pair of upstanding vertically elongated components having upper and lower ends, means pivotally interconnecting the upper ends of said components for relative swinging movement of the lower ends thereof toward and away from each other, the lower end of one of said components including abutment surface means facing toward the lower end of the other of said components, the lower end of said other component including wedge means facing toward said abutment surface means, motor means operatively connected between said components for relatively angularly displacing said components to forcibly swing the lower ends of said components toward each other, a first of said components including depending foot structure supported therefrom for stationary support of said first component from an upwardly facing support surface such as a ground surface and the second of said components including support wheel means journalled from the lower end thereof for rolling support from said support surface.

2. The wood splitter of claim 1 wherein said motor means comprises a hydraulic motor.

3. The wood splitter of claim 2 wherein said hydraulic motor comprises a longitudinally extendable and retractable elongated hydraulic cylinder.

4. The wood splitter of claim 1 wherein said foot structure and wheel means are removably supported from said first and second components, respectively.

5. The wood splitter of claim 1 wherein said first and second components comprise said one and said other components, respectively.

6. The wood splitter of claim 1 wherein said motor means comprises an extendable hydraulic cylinder, and spring means operatively connected between said components yieldingly biasing said components toward positions with said lower ends spaced apart.

7. The combination of claim 6 wherein said motor means comprises a hydraulic motor.

8. The combination of claim 7 wherein said hydraulic motor comprises a longitudinal extendable and retractable elongated hydraulic cylinder.

9. The wood splitter of claim 6 wherein said foot structure and wheel means are removably supported from said first and second components, respectively.

10. The wood splitter of claim 6 wherein said first and second components comprise said one and said other components, respectively.

* * * * *